United States Patent [19]

Brasko

[11] 3,963,594

[45] June 15, 1976

[54] ELECTROCHEMICAL TREATMENT OF ALUMINUM SURFACES WITH AN AQUEOUS SOLUTION OF HYDROCHLORIC ACID AND GLUCONIC ACID

[75] Inventor: Peter Brasko, New Kensington, Pa.

[73] Assignee: Aluminum Company of America, Pittsburgh, Pa.

[22] Filed: June 3, 1975

[21] Appl. No.: 583,438

[52] U.S. Cl. ..... 204/129.95; 204/129.8

[51] Int. Cl.[2] ..... C25F 3/00

[58] Field of Search ..... 204/33, 129.75, 129.85, 204/140, 129.8, 129.1, 129.35, 129.95

[56] References Cited

UNITED STATES PATENTS

| | | | |
|---|---|---|---|
| 2,336,846 | 12/1943 | Clark | 204/129.75 |
| 3,072,546 | 1/1963 | Wruck | 204/33 |
| 3,073,765 | 1/1963 | Adams | 204/141 |
| 3,342,711 | 9/1967 | Shiga et al. | 204/141 |
| 3,365,380 | 1/1968 | Shibasaki | 204/129.8 |
| 3,366,558 | 1/1968 | Shiga et al. | 204/141 |
| 3,389,066 | 6/1968 | Shibasaki | 204/141 |

FOREIGN PATENTS OR APPLICATIONS

| | | |
|---|---|---|
| 831,998 | 4/1960 | United Kingdom |
| 879,768 | 10/1961 | United Kingdom |
| 896,563 | 5/1962 | United Kingdom |

*Primary Examiner*—T. M. Tufariello
*Attorney, Agent, or Firm*—John P. Taylor

[57] ABSTRACT

Aluminum surfaces are electrochemically treated with an aqueous solution of hydrochloric acid and gluconic acid to impart a uniformly coarse texture to the surface thereby rendering it suitable for lithograhic uses.

6 Claims, 5 Drawing Figures

ALUMINUM ASSOCIATION ALLOY 1145 TREATED WITH HYDROCHLORIC-GLUCONIC ACID MIXTURE

ALUMINUM ASSOCIATION ALLOY 1145 TREATED WITH HYDROCHLORIC ACID (PRIOR ART)

ALUMINUM ASSOCIATION ALLOY 1100 TREATED WITH HYDROCHLORIC-GLUCONIC ACID MIXTURE

ALUMINUM ASSOCIATION ALLOY 1100 TREATED WITH HYDROCHLORIC ACID (PRIOR ART)

ELECTROCHEMICAL TREATMENT OF ALUMINUM SURFACES WITH AN AQUEOUS SOLUTION OF HYDROCHLORIC ACID AND GLUCONIC ACID

BACKGROUND OF THE INVENTION

This invention relates to treatment of aluminum surfaces. More particularly, it relates to electrochemical treatment of an aluminum surface to provide a surface thereon suitable for lithographic uses.

Hydrochloric acid electrolytes are commonly used to electrochemically treat aluminum surfaces to render them suitable for subsequent lithographic applications. British Patent Specification 831,998, for example, describes the electrolytical roughening of aluminum foil using a low concentration hydrochloric acid electrolyte for lithographic uses. British Patent Specifications 879,768 and 896,563 and U.S. Pat. Nos. 3,072,546 and 3,073,765 all describe the treatment of aluminum surfaces with hydrochloric acid while applying an alternating current to the aluminum plates to render the plates suitable for lithographic uses. While this treatment has been considered to be satisfactory, it apparently functions best with relatively high purity aluminum alloys such as an alloy having less than half of 1% impurity such as, for example, Aluminum Association Alloy 1145. In addition, it has been found that dissolved aluminum from the treatment, which apparently is in the nature of an etch, accumulates in the hydrochloric acid bath which, in turn, substantially decreases the treatment rate and severely limits the effective bath life.

When the conventional hydrochloric acid treatment is applied to less pure aluminum alloys such as, for example, Aluminum Association Alloy 1100 which may contain as much as 1% silicon plus iron as well as as much as 0.2% copper, the hydrochloric acid tends to preferentially etch certain portions of the metal surface (presumably representing one or more metallic impurities present in the alloy) resulting in a proliferation of such etch pits scattered randomly across the surface. These pits, while microscopic in nature, are much deeper than the desired uniform etching or roughening and therefore can interfere with the subsequent printing process when the surface is subsequently coated with a photosensitive resin such as used in normal lithographic processes.

It is also known to treat aluminum surfaces with certain acids or combinations of acids to achieve polishing effects rather than etching or roughening. For example, Shibasaki U.S. Pat. No. 3,365,380 and Shiga et al. U.S. Pat. Nos. 3,342,711 and 3,366,558, all assigned to Kyowa Hakko Kogyo Company, each refer to an electrolytic polishing effect obtained on aluminum and other metals using a mixture which may include sulfuric acid and gluconic acid.

The same assignee also disclosed in Shibasaki U.S. Pat. No. 3,389,066 the use of combinations of acids including hydrochloric acid and gluconic acid as an electrolytic polishing agent for iron or iron alloys.

It was, therefore, quite surprising to discover that aluminum surfaces, when treated in a special mixture of acids, are roughened more uniformly in a manner conducive to subsequent lithographic uses than was known or predictable from the prior art. Furthermore, such treatment enables the use of less pure alloys such as, for example, Aluminum Association Alloys 1100 and 3003, to be treated without the occurrence of the undesirable preferential deep etching previously discussed. Finally, the treatment apparently also provides a chelating effect to chemically complex the dissolved aluminum and other impurities which form in the bath thus extending the life of the bath.

SUMMARY OF THE INVENTION

In accordance with the invention, a system for the treatment of aluminum to provide a surface thereon suitable for lithographic uses is provided comprising the electrochemical treatment of the surface with a mixture of hydrochloric acid and gluconic acid.

DESCRIPTION OF THE PREFERRED EMBODIMENTS

Figure 1:
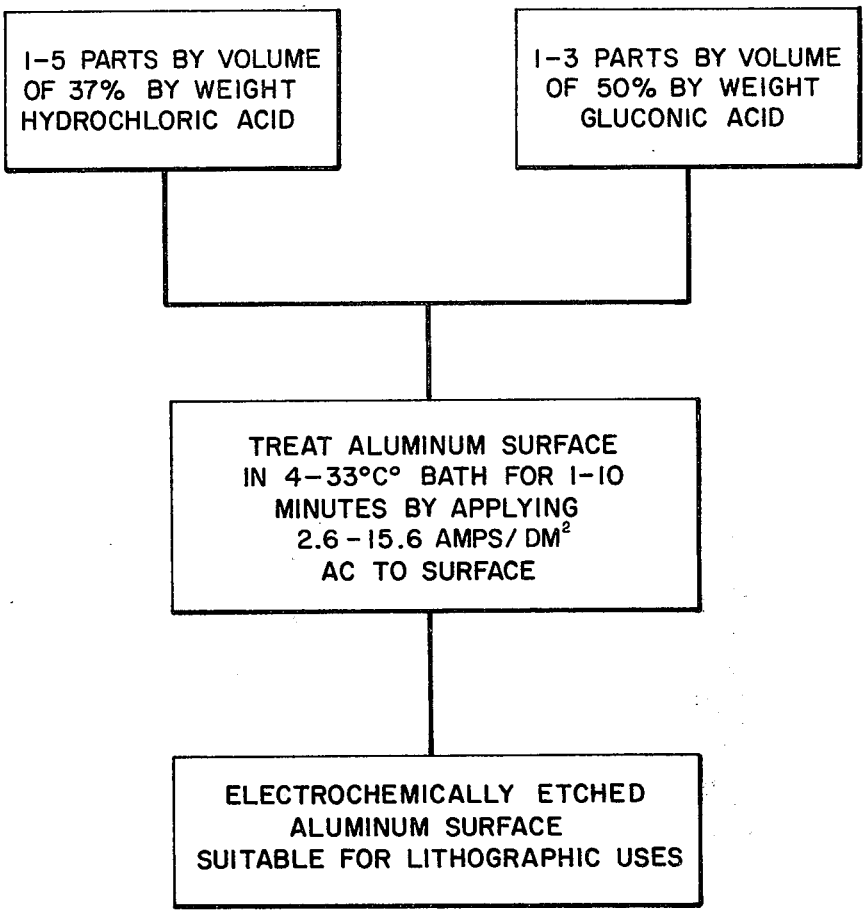
FIG. 1 is a flowsheet illustrating the process aspects of the invention.

In accordance with the invention, aluminum surfaces are electrochemically treated with an aqueous solution of hydrochloric acid and gluconic acid. Prior to the treatment, the aluminum surfaces are processed in accordance with conventional techniques to remove surface oxides as well as any other foreign materials therefrom. This can be conveniently done by wiping the metal samples first in an organic solvent such as acetone or the like followed by etching for from 5 to 10 minutes in a conventional etching solution such as, for example, a 5% sodium hydroxide solution at room temperature. The surface is then desmutted for about 30 seconds in an acid bath such as, for example, a concentrated nitric acid solution (about 50% by weight) at room temperature.

The electrochemical treating solution of the invention comprises a dilute mixture of hydrochloric and gluconic acid which is made by respectively diluting standard 37% by weight concentration hydrochloric acid and commercially available 50% by weight standard solution of gluconic acid. From 1 to 5 parts by volume of the 37% hyrdrochloric solution and from 1 to 3 parts by volume of the 50% gluconic acid solution (or 0.5–1.5% by dry powder weight) are used per 100 parts by volume treating solution with the balance of the parts being water. Preferably, the hydrochloric acid concentration is about 3 parts by volume (of the 37% solution) per 100 parts treating solution. The gluconic acid concentration is preferably about 1 part by volume (of the 50% solution) per 100 parts of the treating solution.

The aluminum surfaces are treated by immersing the surfaces in pairs as opposite electrodes in the electrochemical bath containing the hydrochloric acid-gluconic acid treating solution. The temperature of the bath should be about 4°–33°C. The electrodes should be spaced about 3.8 cm to 15.3 cm and preferably 3.8 to 6.4 cm apart. An alternating current of about 2.6–15.6, preferably about 3.9–7.8, and most preferably 5.8–7.8 amperes per square decimeter (amps/dm$^2$) is then applied to the electrodes for about 1–10 minutes, preferably around 4–8 minutes. It should be noted that this current density is considerably lower then what has been found to be necessary when using only HCl in the bath. For example, when using HCl, a current density of 11.2 amps/dm$^2$ was found to be necessary to achieve surfaces equivalent to that produced in accordance with the invention at a current density of only 7.8 amps/dm$^2$. The current is kept fairly constant with the voltage remaining rather low (i.e. under 15 volts). The term "alternating current" is intended to define a cyclic positive and negative waveform. Conveniently, this can be achieved using conventional 50–60 cycle AC. The bath is mildly agitated throughout the treatment to ensure uniformity of acid concentration and temperature.

After the electrochemical treatment, the aluminum articles are removed from the bath and, after washing in water, are etched for about 20 seconds in a 5% sodium hydroxide solution at room temperature. The surfaces are then desmutted for about 30 seconds in a concentrated nitric acid solution (about 50% by weight) at room temperature. The samples are then washed in water and permitted to air dry. The treated aluminum may now be used as the surface for a lithographic plate by applying thereto the appropriate photosensitive resins such as is well known to those skilled in the art.

The following examples will serve to further illustrate the invention:

EXAMPLE 1

A series of aluminum samples were prepared using respectively Aluminum Association Alloy 1145 and a less pure aluminum material, Aluminum Association Alloy 1100. In each instance, the samples were wiped clean with acetone, etched for 8 minutes at room temperature in a 5% sodium hydroxide solution, and then desmutted for 30 seconds in a room temperature concentrated nitric acid solution (about 50% by weight). The aluminum samples were then electrochemically treated in pairs of the same alloy for 8 minutes with an alternating current of 5.8 amps/dm$^2$ with 5.1 cm spacing, and with an electrolyte temperature of 21°C. One pair of the 1145 alloy samples was treated in the solution of the invention comprising 3 parts by volume HCl (37% by weight concentration) and 1 part by volume gluconic acid (50% by weight concentration) per 100 parts treating solution. One pair of the 1100 alloy samples was also treated in the identical electrolyte. A second pair of the 1145 alloy samples as well as a second pair of the 1100 alloy samples were treated in a prior art type solution containing 3 parts by volume of HCl (37% by weight concentration) per 100 parts treating solution without any gluconic acid. In all instances, the samples were etched after the electrochemical treatment for 20 seconds in a 5% sodium hydroxide solution at room temperature followed by desmutting in the same concentrated nitric acid solution for 30 seconds at room temperature.

Figure 2:
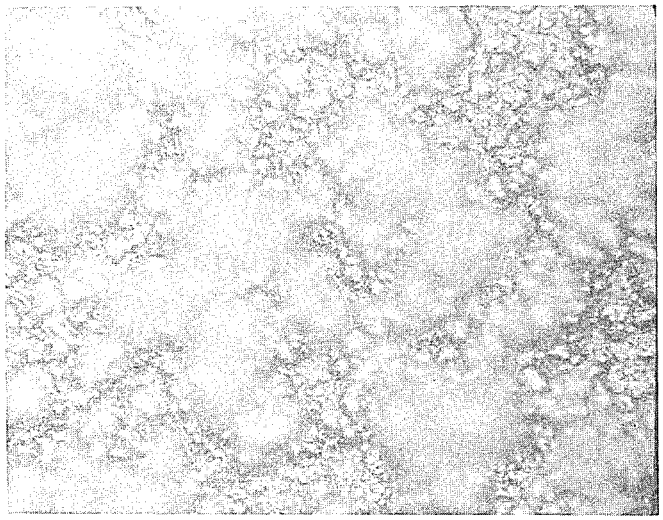
FIG. 2 is a photomicrograph showing the surface of a high purity alloy (Aluminum Association Alloy 1145) electrochemically treated in accordance with the invention.
Figure 3:
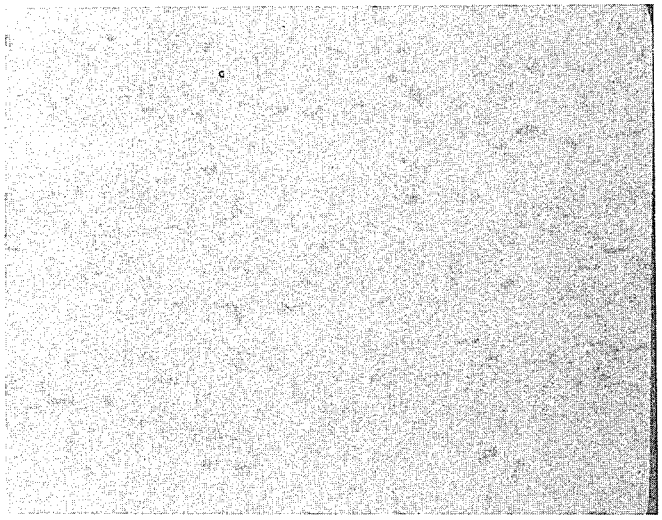
FIG. 3 is a photomicrograph at the same magnification as FIG. 2 showing the surface of the same high purity alloy after a conventional prior art electrochemical treatment with hydrochloric acid.
Figure 4:
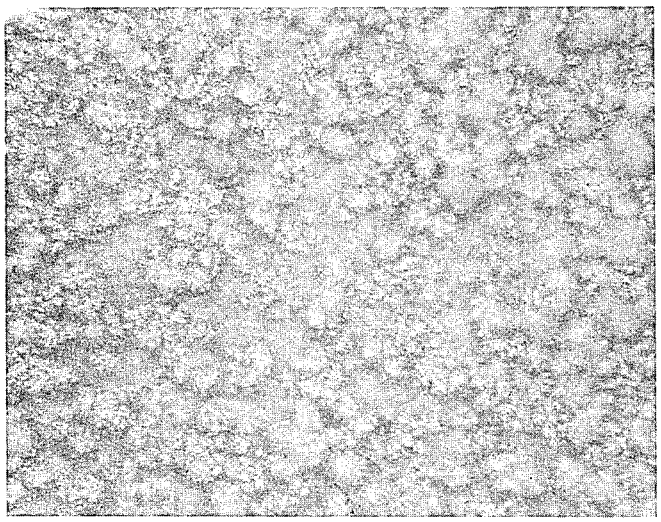
FIG. 4 is a photomicrograph showing the surface of an Aluminum Association 1100 Alloy after electrochemical treatment in accordance with the invention.
Figure 5:
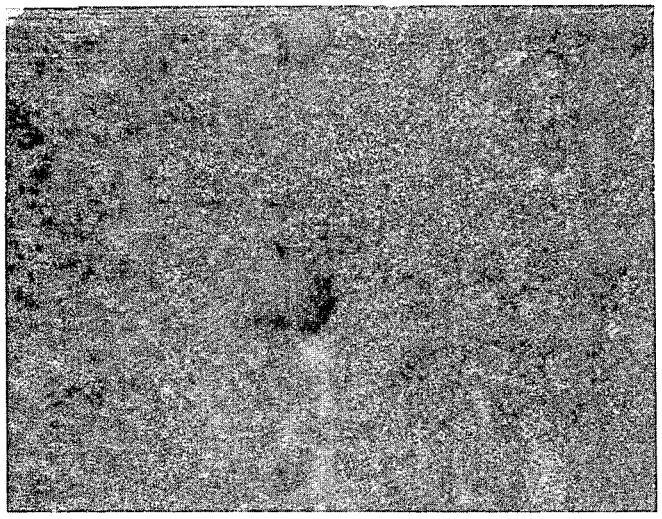
FIG. 5 is a photomicrograph at the same magnification as FIG. 4 showing the surface of the same 1100 alloy after a conventional prior art electrochemical treatment with hydrochloric acid.

Referring to the photomicrographs of FIGS. 2, 3, 4, and 5, it can be seen that the alloys treated in accordance with the invention illustrated in FIGS. 2 and 4 provided a much more uniform and finely grained surface than did the same respective alloys (as illustrated in FIGS. 3 and 5) when treated with the conventional prior art HCl electrolyte.

EXAMPLE 2

To illustrate the results using different bath temperatures, a series of 7.6 cm × 7.6 cm × 0.025 cm samples respectively of Aluminum Association Alloys 1100, 3003, and 1145 (high purity) were etched for 8 minutes at 7.8 amps/dm$^2$ AC in a bath consisting of 3% by volume HCl and 0.5% by weight gluconic acid (1 part by volume of commercially available 50% gluconic acid solution) per 100 parts of electrolyte.

The results are tabulated below:

TABLE I

EFFECT OF ALLOY AND TEMPERATURE ON THE ETCH RATE OF ELECTROCHEMICALLY GRAINED LITHO SHEET SAMPLES

| Elecrolyte | Alloy | Temp., °C | Weight Loss, g/m$^2$ |
|---|---|---|---|
| 3% HCl + 0.5% Gluconic Acid | 1100 | 4° | 13.5 |
| | 3003 | | 13.5 |
| | 1145 | | 13.6 |
| 3% HCl + 0.5% Gluconic Acid | 1100 | 21° | 12.6 |
| | 3003 | | 13.3 |
| | 1145 | | 12.9 |

The results indicate that the temperature has very little effect on the etching rate of the electrolyte.

EXAMPLE 3

To illustrate the beneficial effect of the addition of gluconic acid to the bath with respect to dissolved aluminum therein, a series of etchings were made using Aluminum Association Alloys 1100, 3003, and 1145 (high purity) as in Example 2 and using the same conditions as used therein except as follows.

In each instance, 3% by volume HCl was used in the electrolyte with varying amounts of gluconic acid (expressed in weight %). $AlCl_3$ was also added in varying amounts (expressed in weight %) to simulate the presence of an accumulation of dissolved aluminum and note its effect on bath activity. In each instance, bath activity was measured by weight loss measurement of the sample. All samples were etched at 21°C. The results are tabulated below:

TABLE II

EFFECT OF ALLOY AND ELECTROLYTE COMPOSITION ON THE ETCH RATE OF ELECTROCHEMICALLY GRAINED LITHO SHEET SAMPLES

| Electrolyte | Alloy | Temp., °C | Weight Loss, g/m$^2$ |
|---|---|---|---|
| 3% HCl + 0.5% Gluconic Acid | 1100 | 21° | 12.6 |
| | 3003 | | 13.3 |
| | 1145 | | 12.9 |
| 3% HCl + 0.5% Gluconic Acid + 1% $AlCl_3$ | 1100 | 21° | 12.6 |
| | 3003 | | 12.9 |

TABLE II-continued

EFFECT OF ALLOY AND ELECTROLYTE COMPOSITION ON THE ETCH RATE OF ELECTROCHEMICALLY GRAINED LITHO SHEET SAMPLES

| Electrolyte | Alloy | Temp., °C | Weight Loss, g/m² |
|---|---|---|---|
| | 1145 | | 13.3 |
| 3% HCl + 1% Gluconic Acid + 1% $AlCl_3$ | 1100 | 21° | 12.7 |
| | 3003 | | 12.7 |
| | 1145 | | 13.0 |
| 3% HCl + 0.5% Gluconic Acid + 3% $AlCl_3$ | 1100 | 21° | 10.4 |
| | 3003 | | 11.2 |
| | 1145 | | 12.2 |
| 3% HCl + 1% Gluconic Acid + 3% $AlCl_3$ | 1100 | 21° | 12.4 |
| | 3003 | | 12.7 |
| | 1145 | | 12.7 |
| 3% HCl + 1.5% Gluconic Acid + 3% $AlCl_3$ | 1100 | 21° | 12.7 |
| | 3003 | | 12.6 |
| | 1145 | | 13.5 |
| 3% HCl + 1% $AlCl_3$ | 1100 | 21° | 10.1 |
| | 3003 | | 11.5 |
| | 1145 | | 11.2 |

The results clearly show the marked effect of even 1% $AlCl_3$ on the control electrolyte which omitted gluconic acid. In contrast, the presence of as little as 0.5% by weight gluconic acid renders the electrolyte fairly immune to the effects of 1% $AlCl_3$ while the use of 1% gluconic acid appears to render the electrolyte immune from deleterious effects from the presence of as much as 3% $AlCl_3$.

Thus, in accordance with the invention, a more uniform surface is produced on an aluminum alloy while producing a white matte finish more attractive than conventionally produced grey finishes. Furthermore, the process of the invention permits use of less pure aluminum alloys and/or lower current densities while still producing acceptable surfaces. Finally, the process apparently is not as sensitive as some prior art processes to accumulations of dissolved aluminum in the bath.

What is claimed is:

1. A process for treatment of aluminum to provide a roughened surface thereon suitable for lithographic uses which comprises electrolytically etching the aluminum with a mixture of hydrochloric acid and gluconic acid.

2. The process of claim 1 wherein said hydrochloric acid has a concentration equivalent to 1 to 5 parts per 100 parts treating solution of a 37% by weight hydrochloric acid solution in parts by volume and said gluconic acid has a concentration equivalent to 1 to 3 parts per 100 parts treating solution of a 50% by weight gluconic acid solution in parts by volume.

3. The process of claim 2 wherein said equivalent concentrations are 3 parts by volume hydrochloric acid (37% by weight) and 1 part by volume gluconic acid (50% by weight) per 100 parts by volume treating solution.

4. The process of claim 2 wherein said aluminum is electrolytically treated by immersing at least two pieces of aluminum into said solution at a distance of 3.8 to 15.3 cm apart as opposite electrodes of a 50–60 cycle alternating current source and flowing an alternating current therebetween at a rate of from 2.6 to 15.6 amperes per square decimeter for a period of from 1 to 10 minutes and at a temperature of from 4°–33° Centigrade.

5. An acidic electrolyte for etching of aluminum therein to render the metal suitable for lithographic uses by roughening of the surface which comprises a mixture of hydrochloric and gluconic acids.

6. The electrolyte of claim 5 wherein the concentration of said hydrochloric acid is equivalent to 1 to 5 parts per 100 parts electrolyte of a 37% by weight hydrochloric acid in parts by volume and said gluconic acid has a concentration equivalent to 1 to 3 parts per 100 parts treating solution of a 50% by weight gluconic acid solution in parts by volume.

* * * * *